United States Patent [19]

Kawaji

[11] 4,024,942

[45] May 24, 1977

[54] PRINTER WITH A PAPER GUIDE SEPARATE FROM THE PRINTER FRAME

[75] Inventor: Noboru Kawaji, Ichikawa, Japan

[73] Assignee: Copal Company Limited, Tokyo, Japan

[22] Filed: Oct. 31, 1975

[21] Appl. No.: 627,919

[30] Foreign Application Priority Data

Nov. 8, 1974 Japan ..... 49-134461[U]

[52] U.S. Cl. ..... 197/127 R; 197/133 R; 197/149

[51] Int. Cl.[2] ..... B41J 11/20

[58] Field of Search ..... 197/1 R, 133 R, 144, 197/148, 149, 127 R; 346/76 R

[56] References Cited

UNITED STATES PATENTS

| | | | |
|---|---|---|---|
| 2,039,072 | 4/1936 | Dugdale | 101/269 |
| 3,442,210 | 5/1969 | Hawxhurst | 197/149 X |
| 3,845,850 | 11/1974 | Herr et al. | 197/133 R X |
| 3,848,720 | 11/1974 | Carlsen | 197/1 R |
| 3,855,448 | 12/1974 | Hanagata et al. | 197/1 R X |
| 3,907,090 | 9/1975 | Northfield et al. | 197/1 R |
| 3,929,215 | 12/1975 | Hayakawa | 197/1 R |

*Primary Examiner*—Edgar S. Burr
*Assistant Examiner*—Paul T. Sewell

[57] ABSTRACT

The printer has a printer frame, at least a printing head, a platen and a paper guide. The platen is formed integrally with a frame body in which the paper guide is incorporated so as to form an assembly separate from the printer frame, while the printing head is arranged in the printer frame. The frame body is adjustably secured to the printer frame so that the proper relative positioning between the printing head and the platen is ensured without impairing the guiding operation of the paper guide.

2 Claims, 4 Drawing Figures

PRINTER WITH A PAPER GUIDE SEPARATE FROM THE PRINTER FRAME

BACKGROUND OF THE INVENTION

The present invention relates to a printer and, more particularly, to a printer wherein the platen is integrally formed with the paper guide so as to form an assembly separate from the printer frame while the printing head is disposed on to the printer frame, and the assembly is adjustably secured to the printer frame so that the proper relative positioning between the printing head and the platen is ensured without impairing the guiding operation of the paper guide while the assembly of the printer is made simple.

Heretofore, a thermal or electrically discharging type of printer has been proposed in which a printing head is reciprocally moved and the printing operation is effected during its forward movement with the printing head held so as to be urged against the platen to sandwich a paper sheet to be printed therebetween, while the printing head is held apart from the platen during its return movement so as to allow the paper sheet to be fed. Also, a printer has been proposed in which a plurality of printing heads are provided and all figures or characters are simultaneously printed by the printing heads.

In such a printer of the prior art, the paper guide and the platen have been independently secured to thel printer frame. In the printing operation, the platen must be properly positioned with respect to the printing head or the printing head must strike the platen uniformly, in order to achieve proper printing or to obtain uniform density of the printed character. Therefore, in adjusting the position of the platen, the relative positioning between the platen and the paper guide is necessarily varied thereby deteriorating the paper guiding facility by the paper guide leading to jamming of the paper sheet. In order to avoid such deficiencies, a specially designed paper guide is required or the position of the paper guide per se must be readjusted corresponding to the adjustment of the platen. This makes the printer complicated or the assembly of the printer is made troublesome.

Further, a printer has been proposed in which the platen is moved toward and away from the stationary printing heads instead of the printing heads being moved. In this case, the paper guide is also arranged independently from the stationary printing heads. Therefore, the above described disadvantages can not be avoided.

SUMMARY OF THE INVENTION

The present invention aims at avoiding the above described disadvantages of the prior art printer.

Therefore, an object of the present invention is to provide a novel and useful printer which avoids the above described disadvantages of the prior art printer and which is simple in construction and easy to assemble.

The above object is achieved in accordance with the characteristic feature of the present invention by provision of a printer having a printer frame, at least a printing head, a platen arranged in facing relationship to the printing head so as to cooperate therewith for the printing operation, and a paper guide for guiding and feeding a paper sheet to be printed between the printing head and the platen, the printer comprising a frame body formed integral with the platen, while the printing head is disposed on the printer frame, the frame body incorporating therein for paper guide so as to form an assembly therewith which is assembled independently from the printer frame, the assembly being incorporated in the printer frame and adjustably secured thereto so as to insure proper relative positioning between the platen and the printing head without impairing the guiding operation of the paper guide.

With the construction described above, the printer of the present invention affords proper function thereof while the assembly and adjustment of the printer is very much simplified.

DETAILED DESCRIPTION OF THE PREFERRED EMBODIMENT

Figure 1:
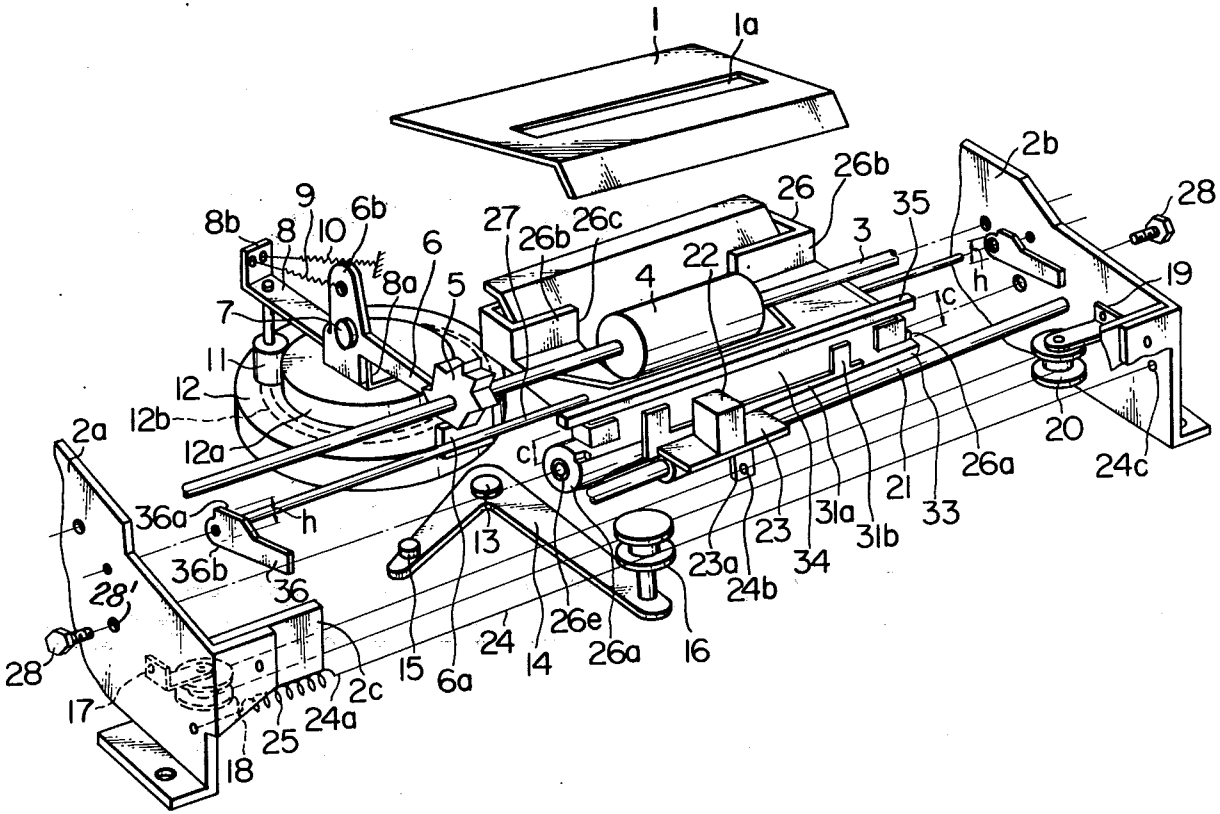
FIG. 1 is an exploded perspective view showing an embodiment of the printer in which the present invention is incorporated.

Referring to FIG. 1, the printer includes a cover 1 having therein a paper threading opening 1*a* and side frames 2*a*, 2*b* as well as connecting frames 2*c* connecting the side frames 2*a*, 2*b*, the frames 2*a*, 2*b*, 2*c* forming the printer frame.

A paper feeding roller 4 and a ratchet 5 are fixedly secured to a paper feeding shaft 3 rotatably supported by the side frames 2*a*, 2*b*.

A paper feeding lever 6 having a bent feeding claw 6*a* is pivotally mounted by a shaft 7 on a bent portion 8*a* of a driving lever 8 which is guided by means (not shown) so as to reciprocally move in the longitudinal direction thereof.

One end of a spring 9 is secured to an angled arm 6*b* of the paper feeding lever 6 while the other end of the spring 9 is attached to an upstanding portion 8*b* of the driving lever 8, so that the level 6 is urged by the spring 9 in the direction in which the paper feeding claw 6*a* is positively engaged with the ratchet 5.

One end of a spring 10 is attached to the upstanding portion 8*b* of the driving lever 8 while the other end is secured to a stationary portion of the printer frame so that the lever 8 and, hence, the paper feeding lever 6 are normally urged in the direction in which the ratchet 5 is driven by the feeding claw 6*a* of the lever 6. Means (not shown) is provided in order to prevent the ratchet 5 from being rotated in the reverse direction.

In order to reciprocally move the lever 8 and hence the lever 6, a rotatable roller 11 is mounted on the lever 8 extending downwardly therefrom adjacent to the upstanding portion 8*b* and the roller 11 is urged by the spring 10 against the periphery of a cam 12*a* of a cam member 12 driven by a motor (not shown) so that the levers 8, 6 are reciprocally moved by the rotation of the cam 12*a* thereby driving the ratchet 5 stepwise by the claw 6*a* of the lever 6. The rotation of the ratchet 5, as determined by the profile of the cam 12*a*, serves to feed the paper sheet by the paper feeding roller 4 during the time after the preceding printing operation has been terminated, but before the succeeding printing operation is commenced as described later.

The paper feed shaft 3 may be provided with a manual feeding knob (not shown) so as to effect manual feeding of the paper sheet.

A grooved cam 12*b* is formed in the lower side of the cam member 12, and a rotatable roller 15 provided at the free end of an arm of an L-shaped lever 14, which is pivoted by a shaft 13 to the printer frame, slidingly engages with the grroved cam 12*b* so that the lever 14 is reciprocally swung as the cam member 12 rotates. A grooved pulley 16 is rotatably supported at the free end of the other arm of the lever 14. The distance between the axis of the shaft 13 and that of the pulley 16 is selected to be twice the distance between the axis of the shaft 13 and that of the roller 15, so that the amount of reciprocal movement of the pulley 16 is made twice the amount of reciprocal movement of the roller 15.

A grooved pulley 18, shown dotted in FIG. 1, is rotatably mounted by a bracket 17 on the frame 2*a*, while a grooved pulley 20 is rotatably mounted by a bracket 19 on the frame 26, as also shown in FIG. 1. On end 24*a* of a wire or string 24 is secured through a spring 25 to the frame 2*a*, and the wire 24 extends toward the pulley 16 and is guided therearound so as to extend in the opposite direction toward the pulley 18. The wire 24 is guided around the pulley 18 so as to extend toward the pulley 20 and it is guided around the pulley 20 so that it extends in the opposite direction toward the pulley 16 and is guided therearound so as to extend to the frame 16, and is secured thereto at 24*c*. The stretches of the wire 24 between the pulleys 16, 18 and 20 are made parallel to each other.

A guide shaft 21 is supported in parallel with the stretch direction of the wire 24 by the frames 2*a*, 2*b*, and a head supporting member 23 having mounted thereon a printing head 22 is slidably and rotatably supported by the shaft 21.

The head supporting member 23 is provided with a projection 23*a* which is positioned adjacent to the stretch of the wire 24 between the pulley 18 and 20.

The wire 24 is secured to the projection 23*a* at 24*b* as shown, so that the printing head 22 is moved together with the wire 24. The other arm of the lever 14 is located perpendicular to the stretch direction of the wire 24 between the pulleys 18, 20 when it is in the midpoint of the reciprocal movement thereof.

Thus, when the lever 14 is reciprocally swung by the rotation of the cam member 12, the wire 24 and hence the printing head 22 is reciprocally moved twice the amount of movement of the pulley 16. Since the amount of movement of the pulley 16 is twice that of the movement of the roller 15, the amount of movement of the printing head 22 is amplified four times with respect to the amount of movement of the roller 15.

The configuration of the grooved cam 12*b* is so selected that the printing head 22 is moved at a uniform speed during the forward movement thereof for the printing operation.

In effect the pulley 16 is moved along an arcuate path instead of a straight path parallel to the direction of stretch of the wire 24 between the pulleys 18, 20, the deviation of the pulley 16 out out of the path of movement of the wire 24 being negligible by virtue of the long distance between the axis of the shaft 13 and that of the pulley 16.

A solid cam (not shown) is formed in the cam member 12 and is engaged with a swingable lever (not shown) so that one end of the swingable lever is reciprocally swung upwardly and downwardly. That one end of the swingable lever is provided with an cam rod (not shown) secured thereto and extending in parallel to the guide shaft 21. The cam shaft is engaged with a roller (not shown) mounted on the head supporting member 23 so that the head supporting member 23 is reciprocally swung a small angle by the actuation of the swingeable lever, as the cam member 12 rotates. The relationship between the phase of the solid cam and that of the grooved cam 12*b* is so determined that the printing head 22 is urged against the platen to be described later during the forward movement of the printing head 22 for permitting the printing operation to be carried out, whereas the printing head 22 is swung so as to be moved apart from the platen during the return movement of the printing head 22 thereby allowing the paper sheet to be fed.

As previously described, the relaionship between the phase of the grooved cam 12*b* and that of the cam 12*a* is so determined that the paper feeding lever 6 is actuated to drive the ratchet 5 and hence the paper feeding roller 4 during the time the head 22 is being returned.

Figure 2:
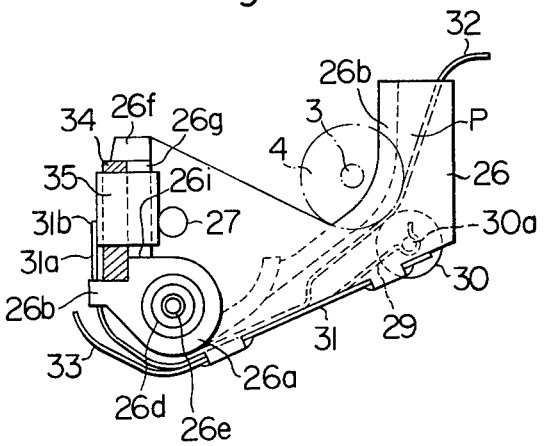
FIG. 2 is a side view showing the platen-paper guide assembly constructed in accordance with the present invention.

In accordance with a characteristic feature of the present invention, a platen 26*g*, cooperating with the printing head 22 and best seen in FIG. 2, is integrally secured to the frame body of the paper guide 31, 32 so as to form an assembly which may be adjustably secured to the printer frame 2*a*, 2i b, 2*c*, so that the paper sheet can be fed properly by cooperating with the paper feeding roller 4, while proper positioning or the platen 26*g*, 34 with respect to the printing heas 22 is ensured.

Figure 3:
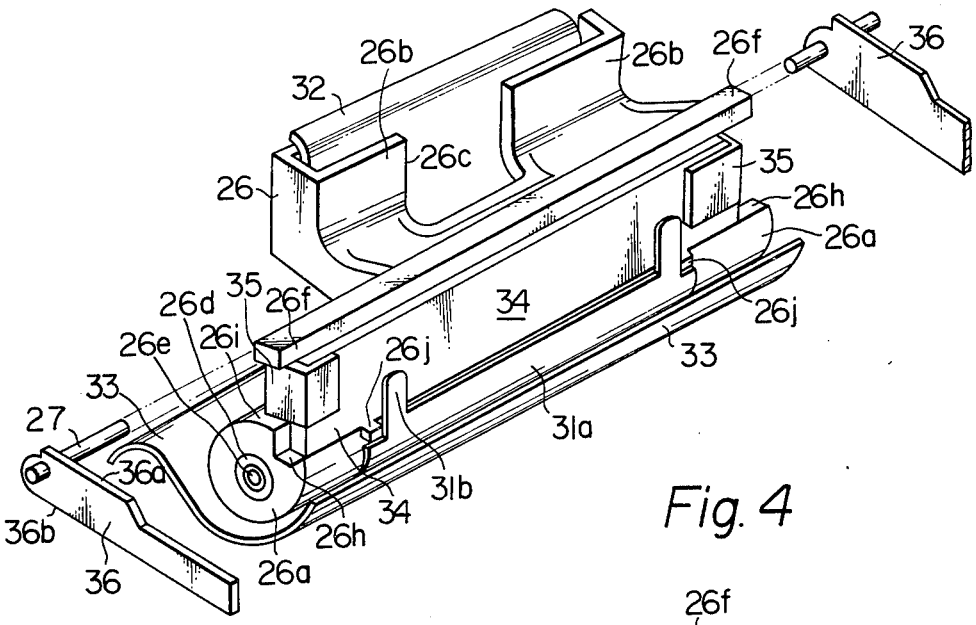
FIG. 3 is a fragmentary exploded perspective view showing the platen-paper guide assembly of FIG. 2 to which adjusting levers are attached.
Figure 4:
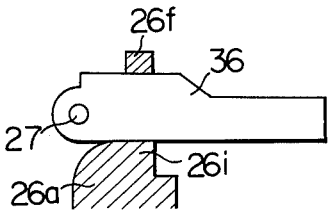
FIG. 4 is a fragmentary side view partly in cross-section showing the engagement of the adjusting lever of FIG. 3 with the platen-paper guide assembly.

Referring now to FIGS. 1 to 3, inclusive, the assembly includes a frame body 26 formed by plastic molding, for example. The frame body 26, formed with a platen 34 and a platen support member 26*g* is swingably supported in the printer frame by a shaft 27 extending through the frame body 26 and supported at its respective ends by the side frames 2*a* and 2*b*, respectively. The frame body 26 is adjustably secured to the printer frame by threaded and fastening set screws 28 passing slidably through holes 28′ in the side frames 2*a*, 2*b* into the threaded holes 26*e* formed in metallic inserts 26*d*, the letter being embedded in bosses 26*a* formed at opposite ends of the frame body 26. Each of the set screws 28 is preferably provided with a hexagonal head so that the screw 28 can be fastened to, and loosened from the upper side of the frame body 26. This permits the adjustment of the angular position of the frame body 26 to be effected very easily without removing the printer out of a narrow space in a computer, in which, for example, the printer is incorporated together with other machine components. Instead of the set screws 28, male threads may be formed in the bosses 26*a* which extend outwardly through loose holes in the side frames 2*a*, 2*b* and nuts may be applied from the outside and fastened to the male threads so as to secure the frame body 26 in the printer frame after adjustment of the angular position of the frame body 26 is effected.

A paper feeding passage P is formed by the inner wall 26*b* and a guide plate 32 arranged in the frame body 26 as shown in FIG. 2. The paper sheet to be printed is first guided by a U-shaped guide plate 31, best seen in FIG. 2, which is fixedly secured to the bottom of the frame body 26, is then guided along the bottom of the frame body 26 and further guided upwardly by the curved portion 31*a* of the plate 31, so that the paper sheet is moved across the front side of the platen support member 26*g*. Inorder to ensure the guiding of the paper sheet along the front side of the platen suport member 26*g*, lugs 31*b* are formed in the upper edge of the curved portion 31*a* at positions at which the operation of the printing head 22 is not prevented. The lugs 31*b* are engaged with projections 26*j* formed in the bosses 26*a* and extending therefrom, so that the curved portion 31*a* is properly positioned with respect to the platen support member 26*g*.

A cutout portion 26*c* is formed in the inner wall 26*b* so that the paper feeding roller 4 can enter the cutout portion 26*c* so as to contact the paper sheet fed into the feeding passage P. In order to ensure positive feeding of the paper sheet by the rotation of the roller 4, a press roller 30 is rotatably and yieldably supported with its shaft 30*a* by a spring 29 secured at its proximal end to the plate 31 so that the roller 30 is urged toward, or abutted against the roller 4 through a cutout portion formed in the plate 32 with the paper sheet sandwiched therebetween.

Forwardly projecting elongated ledges 26*f* and 26*h* are formed along the upper and lower edges of the platen 26*g*.

The respective longitudinal ends of the projecting ledge 26*f* extend beyond the ends of the platen support member 26*g*, while the respective longitudinal ends of the ledge 26*h* terminate at the projecting bosses 26*a* as shown in FIG. 3.

A pad 34 serving with a platen support member 26*g* as a platen per se, and having a length and width equal to that of the platen support member 26*g*, is located between the ledges 26*f* and 26*h* in front of the platen support member 26*g*, and the respective longitudinal ends of the pad or platen 34 are resiliently secured to the respective ends of the platen support member 26*g* by means of channel-shaped or U-shaped clip springs 35. The pad or platen 34 is adapted to make contact, and cooperates with the printing head 22 during the forward movement thereof for the printing operation.

An outer plate 33 is secured to the frame body 26 outside of the curved portion 31*a* of the plate 31 so as to protect the curved portion 31*a* while dust produced by the paper sheet during the printing operation are received by the plate 33 so as to prevent the dust from entering the internal mechanism of the printer.

As shown in FIG. 1, a distance *c* is provided between the each end of the ledge 26*f* and the each projecting portions 26*i* (FIG. 3) of the boss 26*a*. An adjusting lever 36 is arranged adjacent to the inner wall of the respective frame 2*a*, 2*b*. Each of the levers 36 is fitted on the shaft supporting the frame body 26 and is formed with parallel side edges 36*a*, 36*b*. The distance *h* between the side edges 36*a*, 36*b* is so selected that the side edges snugly engage in the distance *c* formed between the end of the ledge 26*f* and the projecting portion 26*i*. Thus, when the lever 36 is manually actuated to swing about the shaft 27, the frame body 26 is also swung about the shaft 27 by virtue of the engagement of the side edges 36*a*, 36*b* of the lever 36 with the ledge 26*f*, and the portion 26*i* of the platen 26*g*, the distance between which is C, thereby permitting the frame body 26 to follow the rotation of the lever 36. The manipulation of the lever 36 can be effected from the upper side of the frames 2*a*, 2*b*. The swinging of the frame body 26 permits the proper relative positioning of the platen and the printing head to be achieved. The holes formed in the printer frame 2*a*, 2*b* for passing screws 28 therethrough so as to secure the frame body to the printer frame are in the form of enlarged holes or enlongated slots thereby permitting the frame body 26 to be swingably and adjustably secured about the shaft 27 to the printer frame by the set screws 28.

The present invention also applies to a printer in which a plurality of printing heads are provided so as to print the characters for all the figures simultaneously.

In the above description, the paper guide is integrally formed with the platen. However, the platen can be replaced by the printing heads stationarily arranged integral with the paper guide, and the platen may be moved toward and away from the printing heads.

The aforesaid invention is not restricted to a construction wherein a single printing head 22 is moved along the guide shaft 21. The present invention is equally applicable to a device in which a plurality of printing heads are provided in juxtaposed relation to each other, and are successively actuated in sequence for printing a line of printing. The present invention can also be applied to a device in which a plurality of printing heads are secured to the frame body 26 in place of the pad, and the pad per se is swingably arranged in facing relation to the heads, so as to move toward, and away from the heads.

I claim:

1. A printing device having a printer frame, at least a printing head, a platen arranged in facing relationship to said printing head so as to cooperate therewith for a printing operation, and a paper guide for guiding and feeding a paper sheet to be imprinted between said printing head and said platen, the improvement comprising a frame body formed integral with said platen and said paper guide, said printing head being movable in said printer frame, said frame body forming with said paper guide an assembly assemblable independently of said printer frame, a shaft extending through said frame body and said printer frame, and wherein said frame body is swingably supported in said printer frame by said shaft, said frame body having at least a recessed portion at an end thereof adjacent to an inner wall of said printer frame and remote from a position at which said shaft extends through said frame body, at least a lever having a shaft-proximal end being supported at said proximal end by said shaft between said inner wall of said printer frame and said end of said frame body, said lever having an arm engageable in said recessed portion of said frame body, whereby the position of said platen relative to said paper guide is maintainable upon adjustment of the position of said platen with respect to said printing head without impairing the paper sheet guidance of said paper guide, and the adjustment of the angular position of said frame body is facilitated by manipulation of said lever.

2. A printing device having a printer frame, at least a printing head, a platen arranged in facing relationship to said printing head so as to cooperate therewith for a printing operation, and a paper guide for guiding and feeding a paper sheet to be imprinted between said printing head and said platen, the improvement comprising a frame body formed integral with said platen and said paper guide, said printing head being movable in said printer frame, said frame body forming with said paper guide an assembly assemblable independently of said printer frame, a plurality of fastener means for securing said frame body to said printer frame, and wherein the latter is formed with a plurality of holes for said frame body to be pivotably and adjustably secured to said printer frame by said fastener means slidably passing through said holes, respectively, whereby the position of said platen relative to said paper guide is maintainable upon adjustment of the position of said platen with respect to said printing head without impairing the paper sheet guidance of said paper guide.

* * * * *